US005830116A

United States Patent [19]

Gautier

[11] Patent Number: 5,830,116

[45] Date of Patent: Nov. 3, 1998

[54] MULTIEXERCISE WEIGHT LIFTING MACHINE

[76] Inventor: Kenneth Bryan Gautier, 7211 Sheffield Sq., Nashville, Tenn. 37221

[21] Appl. No.: 326,198

[22] Filed: Oct. 20, 1994

[51] Int. Cl.[6] ..... A63B 21/062

[52] U.S. Cl. ..... 482/99; 482/100; 482/137; 482/908

[58] Field of Search ..... 482/45, 46, 92–94, 482/98–103, 133–138, 908

[56] References Cited

U.S. PATENT DOCUMENTS

| | | | |
|---|---|---|---|
| 3,856,297 | 12/1974 | Schnell | 482/97 |
| 4,494,751 | 1/1985 | Schnell | 482/136 |
| 4,511,137 | 4/1985 | Jones | 482/100 |
| 4,600,189 | 7/1986 | Olschansky et al. | 482/142 |
| 4,635,933 | 1/1987 | Schnell | 482/137 |
| 4,666,149 | 5/1987 | Olschansky et al. | 482/130 |
| 4,709,920 | 12/1987 | Schnell | 482/908 |
| 4,799,670 | 1/1989 | Williamson | 482/97 |
| 4,834,396 | 5/1989 | Schnell | 482/97 |
| 4,884,801 | 12/1989 | Schnell | 482/97 |
| 4,957,281 | 9/1990 | Christolear, Jr. | 482/100 |
| 5,039,089 | 8/1991 | Lapcevic | 482/97 |
| 5,067,708 | 11/1991 | Olschansky et al. | 482/137 |
| 5,242,344 | 9/1993 | Hundley | 482/93 |
| 5,250,013 | 10/1993 | Brangi | 482/908 |
| 5,308,304 | 5/1994 | Habing | 482/137 |

FOREIGN PATENT DOCUMENTS

| | | | |
|---|---|---|---|
| 3011404 | 10/1981 | Germany | 482/99 |

*Primary Examiner*—Jerome Donnolly
*Assistant Examiner*—Victor K. Hwang
*Attorney, Agent, or Firm*—Steven R. Scott

[57] ABSTRACT

A multiexercise weight lifting machine which features in its most basic embodiments a gearbox capable of converting the torque input through a first axle from a source of resistance (such as a weight stack) into a greater torque output at a second axle to which is connected a user interface (such as a handle); which gearbox is slidably mounted on a linear member such that the gearbox can be moved to different positions along the length of the linear member to allow different types of exercises. In its preferred embodiments it also features means for reversing the torque output at the second axle and user interface. Its numerous functions and benefits may also be supplemented by addition of a weight bench, provision of means for changing the gear ratio of the gearbox, and other features.

20 Claims, 4 Drawing Sheets

MULTIEXERCISE WEIGHT LIFTING MACHINE

BACKGROUND OF THE INVENTION

1. Field of the Invention

This invention relates generally to the field of exercise devices and weight lifting machines. More particularly, it relates to the field of multiexercise weight lifting machines wherein alternate means have been developed to reduce or replace the heavy weights generally associated with weight lifting machines.

2. Prior Art in the Field

The practice of utilizing weight lifting equipment to build muscle size and strength has greatly accelerated over the last fifty years. The type of equipment initially developed and utilized for this purpose consisted of various free weights which were lifted against the force of gravity by the user. In more recent times, the use of free weights has been partially superseded by the use of exercise machines. Exercise machines can, in general, be subdivided into two basic categories. The first basic category includes machines which have as their principal goals weight loss and the development of endurance and cardiovascular fitness. This category includes exercise bicycles, rowing machines, and other devices which allow the performance of a repetitive exercise or movement over an extended period of time. The second basic category of machines focuses primarily on the development of muscle size and strength. These devices (hereinafter referred to as "weight lifting machines") generally require the performance of exercises in which the muscles must be used, with limited repetitions, to overcome a resistant force close to the maximum possible for the user to overcome.

Weight lifting machines, like free weights, generally utilize gravity acting on a weight or set of weights to create the resistance which the user of the machine must overcome in his or her utilization of the device. However, unlike the earlier free weights, the force of gravity acting on the weight is not overcome by direct movement of the weight itself. Instead, the force is generally transmitted via a series of chains, cables and/or pulleys to a handle or other member (hereinafter referred to as the "user interface") which the user directly contacts and seeks to move. Most often, the user interface is in the form of a handle, and is part of a lever arm pivotally connected to the frame of the device. Thus, the user typically applies his or her strength to the movement of the lever arm(s) via the user interface rather than directly applying his or her strength to the movement of the weight.

The introduction and development of weight lifting machines has greatly increased the possibilities for both the athlete involved in their use and the developer intent on their design. Free weights, despite the many possible variations of exercise they allow, ultimately restrict the user to exercises where the weight is pushed or pulled upward against the force of gravity. Weight lifting machines transcend this restriction. The user is not limited to lifting exercises, as with free weights, for exercise machines can be designed that allow the user to: (a) exert force with any limb or part of the body by (b) moving a handle or other member serving as a user interface in any direction chosen by the designer.

This innovation has allowed the development of a very wide variety of weight lifting machines. However, these machines can be further subdivided into two broad groups: (1) Single exercise machines that are designed solely and exclusively for one particular exercise; and (2) multistation machines that provide a variety of exercise stations and exercise possibilities on a single machine. Examples of the first group may be seen in the following patents:

(1) U.S. Pat. No. 4,500,089 issued to Jones for a *Weight Lifting Lower Back Exercising Machine.*

(2) U.S. Pat. No. 4,807,874 issued to Little for a *Combination Plantar Flexion/Dorsiflexion Ankle Machine.*

(3) U.S. Pat. No. 5,076,779 issued to Webb for a *Torso Exercise Machine with Range Limiter.*

Both types of weight lifting machines generally utilize only one weight stack (which serves as the source of resistance for the user) and link the user interface to that weight stack via a series of chains, cables or other mechanisms. However, the multistation machine is typically characterized by the presence of several "stations" or locations on or around the machine at which different user interfaces are located and different exercises involving different parts of the body may be performed. Each station will typically include the means for the performance of one particular exercise. More recently, multistation machines have been developed that allow for the reconfiguration of a single location on the machine for the performance of alternate exercises at that location.

This type of machine (hereinafter referred to as a "multiexercise weight lifting machine") is advantageous both to manufacturers and to users. For the manufacturer, it allows the production of a smaller machine (with consequent reduction in material costs and weight) which is capable of performing the same functions of larger, heavier machines. This difference is also attractive to consumers as it provides the advantages of a multistation machine in a device which is more compact, less expensive, and easier to fit into the home use environment.

There is, nonetheless, a continuing need to develop multiexercise devices that simply and efficiently perform the functions of a multistation weight lifting machine in a compact format with minimal materials and weight. This has led to the development of multiexercise devices which seek to reduce or eliminate the use of the weight stack as the ultimate source of resistance to be overcome by the user. The patent issued to Connelly for a *Resilient Type Exercise Device with Removable Weights* (U.S. Pat. No. 4,492,375) provides one example of a multiexercise machine of this type. The Connelly patent discloses a multiexercise machine in which resistance is provided not by weights, but by torsional springs or elastic bands. However, this resistance is experienced only when the user interface is moved in one direction (upward). Another example is provided in the patent issued to Wilson for a *Multi-purpose Exercise Device* (U.S. Pat. No. 4,072,309). Wilson also utilized elastic bands to provide resistance, but adds means by which the resistance may be experienced not only when the user interface is moved upward, but when it is moved downward. However, these devices have a serious defect from the standpoint of most exercise physiologists as well as most enthusiasts. The resistance experienced by the user is not constant ("isotonic"), but increases as the mover interface is displaced from its starting position and the spring and/or elastic band is compressed/stretched.

An attempt to overcome this problem may be seen in the Nordicflex devices currently being marketed by the NordicTrack Company. These multiexercise devices utilize an "isokinetic resistance mechanism" which, in essence, provides variable resistance to movement of the user interface via a frictional brake. However, many exercise physiologists and most enthusiasts continue to prefer the physiological benefits and the "feel" of weight lifting machines wherein the source of resistance is isotonic, as it is in most of the older weight lifting machines (where it is provided by a weight stack). At a more intangible level, there is also a degree of consumer prejudice in the field favoring the older, more substantial weight lifting machines utilizing weight stacks (which are associated with the heavy duty professional equipment used in most gyms) over the more light weight innovations outlined above. Thus, despite the innovations previously described, there is a continuing need and market for designs that will provide the versatility of a multiexercise device, be lower in weight than conventional weight lifting machines, provide a relatively constant source of resistance to the user, and wherein the source of resistance is (preferably) a weight stack.

SUMMARY AND OBJECTS OF THE INVENTION

The instant disclosure describes a novel multiexercise weight lifting machine which meets the design objectives set forth above. In its preferred embodiment it features: (a) a horizontal base of support; with (b) an upright vertical member arising therefrom; to which vertical member is fastened (c) a sleeve member; on which (d) a compact assemblage of directly linked gears in series without intervening belts, pulleys or flexible linkages serving as a direct drive force transformation and/or multiplication mechanism (the aforesaid being commonly referred to in the mechanical arts as a "gear box" and being hereinafter referred to as a "direct drive gear box") with a first axle and a second axle is mounted; where said first axle has connected thereto (e) a user interface element (generally in the form of a lever arm); and said second axle is connected via sprockets, chains, cables and/or other means to (f) a weight stack in such manner that movement of the user interface element, being transferred through the first axle to the direct drive gear box and therefrom to the second axle, causes the said weight stack to be displaced upward against the resistant force of gravity. The instant invention also has features that: (1) allow it to produce a resistance in excess of the weight being lifted with consequent reductions in the weight of the device; (2) allow the direction of resistance to be reversed so that the device can be utilized for both extension and contraction types of exercises at the same station; and (3) allow it to be quickly and easily adapted for use in different types of exercises for different muscle groups. These elements and features may also be supplemented by the provision of: (1) a removable weight bench that expands the number and type of exercises that can be performed on the instant device; (2) additional user interface elements that expand the number and type of exercises that can be performed on the instant device; and (c) additional gearing and gear shifting possibilities in the direct drive gear box that allow the amount of resistant force provided by the weights utilized in the device to be varied widely without actually increasing the number and amount of said weights. These and other features of the multiexercise weight lifting machine described herein are explored in more detail below.

DETAILED DESCRIPTION OF THE PREFERRED EMBODIMENT

Figure 1:
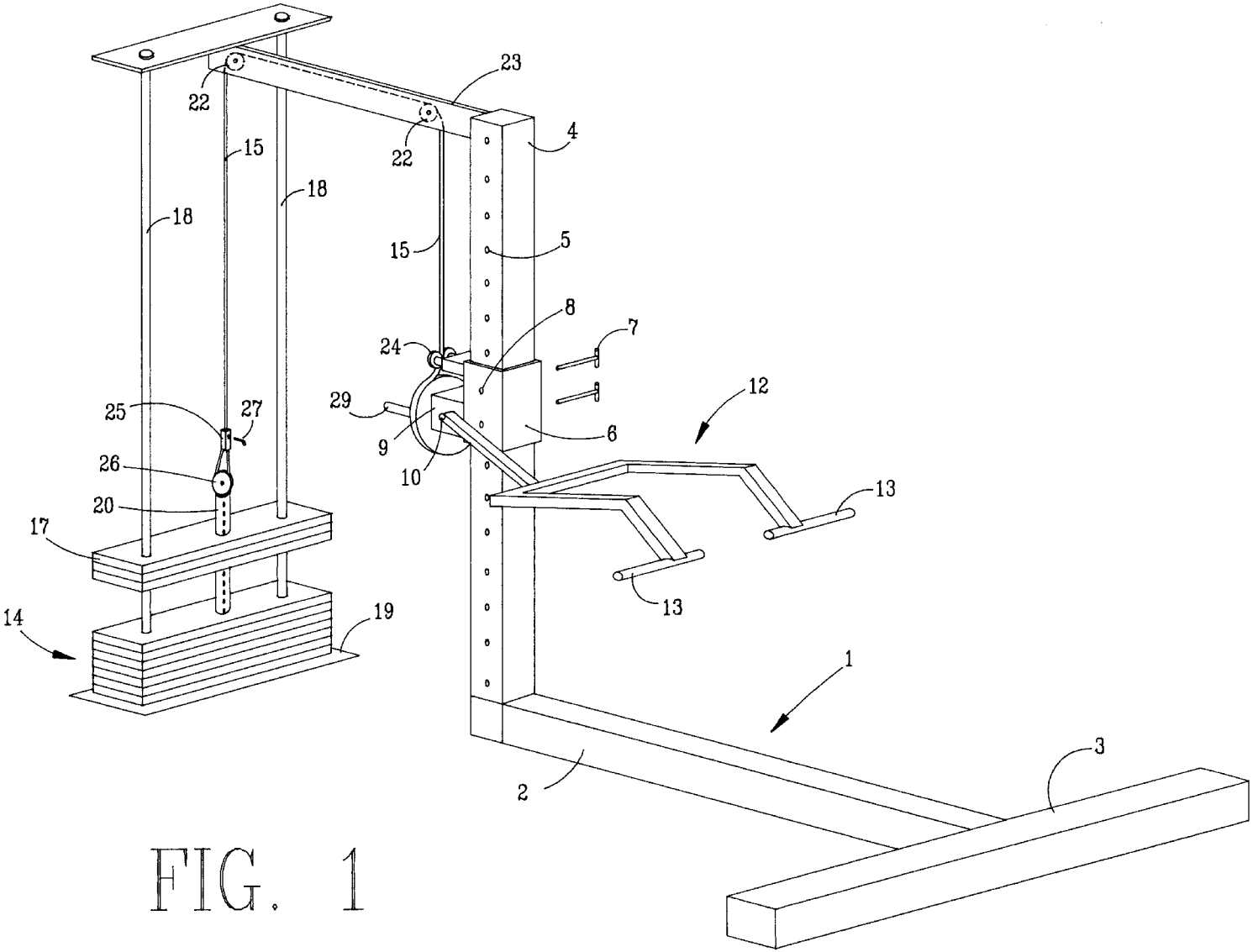
FIG. 1 provides a perspective view from above and to the front and side of the preferred embodiment of this invention.

It has been found advantageous to provide a base 1 for the device of the type and shape illustrated in FIG. 1. The simple "T" shape utilized for the base 1, which is defined by a long member 2 and a cross member 3, provides stability with a minimum of materials. It, as well as the rest of the elements of the machine may be formed from steel, aluminum or other suitable materials using techniques and methods well known in the art. The vertical member 4 may, as illustrated in FIG. 1, be connected at right angles to the end of the long member 2 opposite the cross member 3. The vertical member 4 also may, as shown in the figure illustrated, be formed from materials similar to those used in the base 1. In practice, it has been found that steel is highly suitable for use in the construction of both elements. The following approximate dimensions may be advantageously utilized in constructing these elements: (1) six (6) feet has been found to be an optimum length for the long member 2; (2) four (4) feet has been found to be an optimum length for the cross member 3; and (3) eight (8) feet has been found to be an optimum height for the vertical member 4.

As further illustrated in FIG. 1, the vertical member 4 is provided with holes 5 placed at even (approximate 6 inch) intervals along its length. (Only one of the holes 5 has been denominated to avoid overcrowding in the drawing figure). The vertical member 4 also has, slidably located thereon, a sleeve 6. The holes 5 may serve multiple functions. They may, for example, be utilized to anchor and affix a bench or other device related to the use of the device. However, in the embodiment illustrated in FIG. 1, they serve only as a means for anchoring the sleeve 6 at particular locations on the vertical member 4. This may be accomplished via the use of a pin 7 (only one of which is denominated to avoid overcrowding in the drawing figure), which can be simultaneously placed through sleeve holes 8 (in the sleeve 6) and holes 5 (in the vertical member 4) by alignment thereof.

Figure 3:
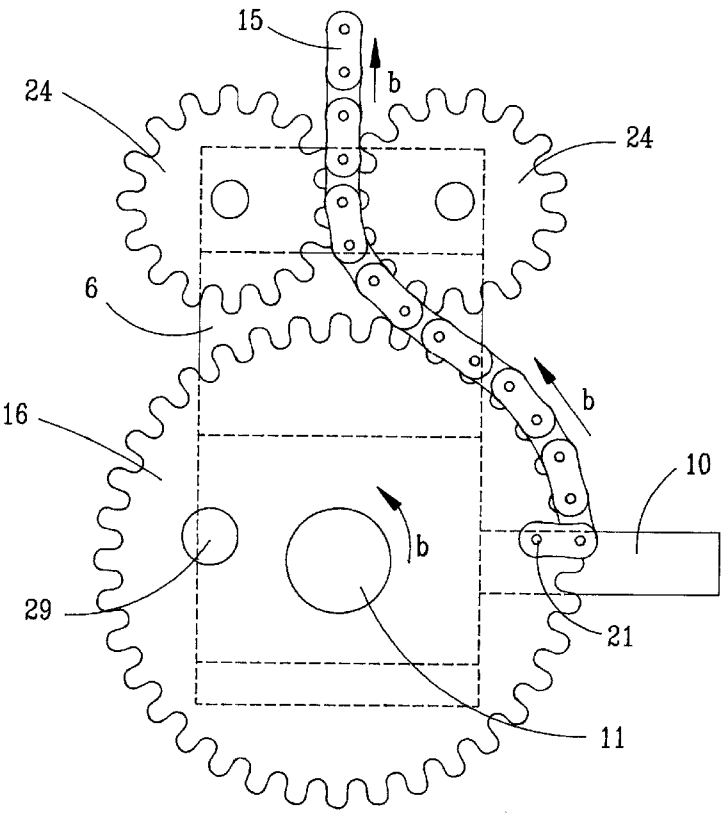
FIG. 3 provides a view from the rear of the direct drive gear box on the slidable sleeve characterizing this invention with the sprocket and chain affixed thereto in a second position.
Figure 2:
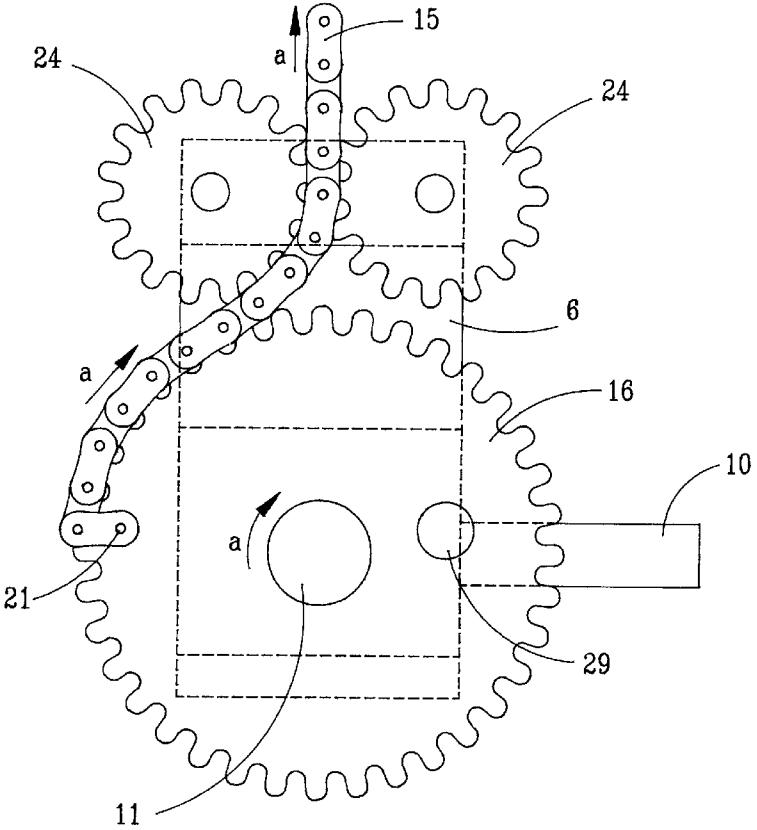
FIG. 2 provides a view from the rear of the direct drive gear box on the slidable sleeve characterizing this invention with the sprocket and chain affixed thereto in a first position.

A direct drive gear box 9 is fixed to the sleeve 6. As illustrated in FIGS. 1 through 3, the direct drive gear box 9 may be advantageously provided with a first axle 10 and a second axle 11 that are at right angles to each other. (It would, however, also be possible to utilize a device where the first axle 10 and the second axle 11 were located in a different relationship). The first axle 10 serves as the means of connection to the device for the lever arm 12. Lever arm 12 is provided with handles 13 which may be gripped by the user when utilizing the instant invention. In the embodiment shown, it measures approximately 36 inches in length from its point of connection to the first axle 10 to its handles 13. As is typical with devices of this type, it serves as the primary user interface with the apparatus. The second axle 11 serves as the means of connection to the weight stack 14 via chain 15, gearbox sprocket 16, and other intermediate elements described below.

As illustrated, the weight stack 14 and its associated assembly may be formed in a manner that is, in general, typical to weight lifting machines. Thus, the weight stack 14 is made up of individual weights 17 (only one of which is labelled to avoid overcrowding of the drawing figure) which are free to slide up and down on a pair of weight stack guides 18 which extend upward from weight stack base 19. The user is free to select how many of the individual weights 17 at the weight stack 14 will be lifted by adjustments of the lifting rod 20 and a set pin (not shown), all as well known and practiced in the art of weight lifting machines. The individual weights 17 are, when these adjustments are completed, firmly connected to chain 15. Chain 15, in turn, extends from the individual weights 17 upward to the redirection sprockets 22 located on supporting arm 23, across the aforesaid redirection sprockets 22, down through the centering sprockets 24 mounted on the sleeve 6, and is joined by a pivoting chain link 21 to gearbox sprocket 16, which is (as previously discussed) mounted on direct drive gear box 9.

The use of a direct drive gear box is not well known in this art area and, to the inventor's knowledge, this invention is the first of its type to utilize a direct drive gear box fixed to a moveable sleeve in the design of a multiexercise weight lifting machine. However, the design of direct drive gear boxes is well known in the mechanical arts and widely practiced. Thus, the inventor will not further describe the inner workings of the gearbox 9 utilized other than to delineate the following desirable characteristics to be sought in the gearbox selected: (1) it should be compact in size; (2) it should be of minimal weight in order to accomplish the overall goal of minimizing the total weight of the weight lifting machine, and to facilitate the use of the machine; and (3) it should be durable and well made in such manner as to withstand the weight load placed thereon.

Figure 5:
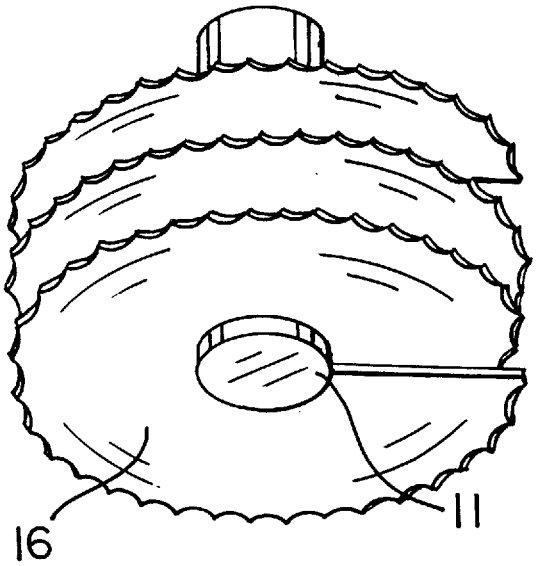
FIG. 5 provides a perspective view of a spiral sprocket suitable for use in this invention.

The inventor has determined that optimum performance in this area may be achieved by the utilization of direct drive gear boxes adapted for use with electric motors such as those produced by the Ohiogear Company. The type illustrated in FIGS. 1 through 3 is a Uniline Single Reduction "B" Style gearbox with a 6 to 1 reduction ratio produced by this company. Different ratios may be utilized in other embodiments and direct drive gear boxes featuring multiple ratios with gear changing capacities may also be used and are anticipated by this invention. Thus, the ratio given is not required to insure the proper functioning of all embodiments of this invention. However, the ratio given is important when considered in the context of the embodiment illustrated in FIG. 1 as it affects the degrees of arc through which the lever arm 12 may be moved in that embodiment. A 6 to 1 ratio allows the lever arm 12 to be moved through its full anticipated arc of sixty (60) degrees without rotating the second axle 11 more than three hundred and sixty (360) degrees. A rotation of more than 360 degrees in the second axle 11 would cause the chain 15 which is illustrated in this embodiment to impinge upon itself and probably to slip from the teeth of gearbox sprocket 16. This problem could be overcome by the use of a spiral sprocket or some other means; however, it is deemed simpler and more advantageous to use a simple sprocket of the type illustrated for gearbox sprocket 16 in FIGS. 1 through 3 for most purposes. An alternate spiral sprocket 16 is illustrated in FIG. 5.

The gearbox sprocket 16 is, in the embodiment shown, 24 inches in diameter. Thus, the combined effects of the gear ratio produced by the direct drive gear box 9, first lever arm 12 and the gearbox sprocket 16 may be expressed as follows, where F1 is the force necessary for the user to exert to displace the lever arm 12 when F2 is the amount of weight being displaced at weight stack 14:

(1) Without including any factors which are a function of the length of the lever arm 12 or the radius of the gearbox sprocket 16, the force necessary to be exerted to rotate first axle 10, which is equal in radius to second axle 11, would be 6 times the force placed on the second axle 11 by the weight stack 14 (i.e. $-F1=6(F2)$).

(2) However, as the length of the first lever arm 12 is 3 times the radius of the gearbox sprocket 16, the mechanical advantage inherent in this difference must also be considered. In taking this additional factor into consideration, it will be found that the force experienced by the user in attempting to displace the lever arm 12 may be determined via the following equation: $3\times F1=1\times 6(F2)$. The force experienced by the user in displacing lever arm 12 is, therefore, equal to 2(F2).

Thus, the embodiment shown provides a resistant force to the user attempting to displace the lever arm 12 equal to twice the weight being displaced at the weight stack 14. This, in turn, allows the use of a weight stack weighing only half what would otherwise be required in a machine of this type with a consequential lowering of the weight of the entire apparatus. It also allows the apparatus to be manufactured from lighter weight materials. All of these factors result in a lowering of its cost of manufacture as well as its ultimate cost to the user.

In use, the embodiment shown proves to be both simple and versatile. By way of example, one may consider a user who wishes to perform an exercise in which the handles 13 (at rest) are set at approximately chest height as he or she adjusts and sets the embodiment shown in FIG. 1 for this purpose. The user would begin by adjusting the height of the sleeve 6. (This may be done with or without first removing the lever arm 12 from its usual position affixed to the first axle 10). After the user has slid the sleeve 6 to the appropriate height on the vertical member 4, the user would insert the pins 7 through the sleeve holes 8 and the holes 5 in the vertical member 4 located at that position. Having fixed the sleeve 6 in position by the pins 7, the user will next need to take any slack out of the chain 15.

As will be obvious from a review of FIG. 1, the chain 15 must be long enough to function (when fully extended) with the sleeve 6 affixed at the lowest possible point on the vertical member 4. However, as the sleeve 6 is moved upward from this position, it will necessarily create slack in the chain 15. This slack must be taken up, effectively shortening the length of chain 15, so that the chain 15 can serve its function in linking the weight stack 14 to the gearbox 9. The means by which this is accomplished may best be understood by reference to FIG. 4, which illustrates the linkage adjustment bracket 25, and associated elements.

As will be evident upon examination of FIG. 5, the chain 15 in the embodiments illustrated passes through the linkage adjustment bracket 25 and the linkage adjustment pulley 26 (which is attached to the top of the lifting rod 20) and loops back to connect to the linkage adjustment bracket 25. The linkage adjustment bracket is slidably mounted on the chain 15, but may be fixed in position by insertion of a pull pin 27 through a bracket hole 28 (the position of which is indicated generally by an arrow, but which is not shown in the figure). Thus, in order to take slack out of the chain 15 and shorten it (as will be necessary any time the sleeve 6 is moved from a lower to a higher position on the vertical member 4), all the user need do is to remove the pull pin 27 from the linkage adjustment bracket 25, slide the linkage adjustment bracket 25 upwards on the chain 15 until the chain is taut and the slack is removed, and reattach the linkage adjustment bracket 25 to the chain 15 in this new position by means of pull pin 27. Likewise, when it is necessary to provide additional chain length as the sleeve 6 is moved downward, this process may be reversed.

In addition to the versatility provided by: (a) the user's ability to adjust the amount of resistant force by adjustment of the number of individual weights 17 attached to the chain 15; and (b) the user's ability to adjust the resting height of the lever arm 12 by movement of the sleeve 6, both as discussed above; the instant invention also provides (c) a quick and easy way in which to change the direction of the resistant force experienced by the user from a downward to an upward direction. This is done by changing the direction in which the chain 15 is wrapped around the gearbox sprocket 16, and may best be understood by reference to FIGS. 2 and 3.

In FIG. 2 the chain 15 is illustrated in a first position on the gearbox sprocket 16 and the arrows "a" illustrate the direction of the force placed on the chain 15, the gearbox sprocket 16, and the second axle 11 as a result of the individual weights 17 affixed to the chain 15. In this position, the gearbox sprocket 16 and the first axle 10 are both biased in a clockwise direction. This produces a downward biasing in the lever arm 12 when it is attached to the first axle 10 and, hence, provides a resistant force to the user seeking to move the lever arm 12 upward. Likewise, when the chain 15 is placed in its second position on the gearbox sprocket 16, as illustrated in FIG. 3, the gearbox sprocket 16 and the first axle 10 are biased in a counterclockwise direction, as shown by arrows "b" in FIG. 3. This produces an upward biasing in the lever arm 12 when it is attached to the first axle 10 and, hence, provides a resistant force to the user seeking to move the lever arm 12 downward.

Figure 4:
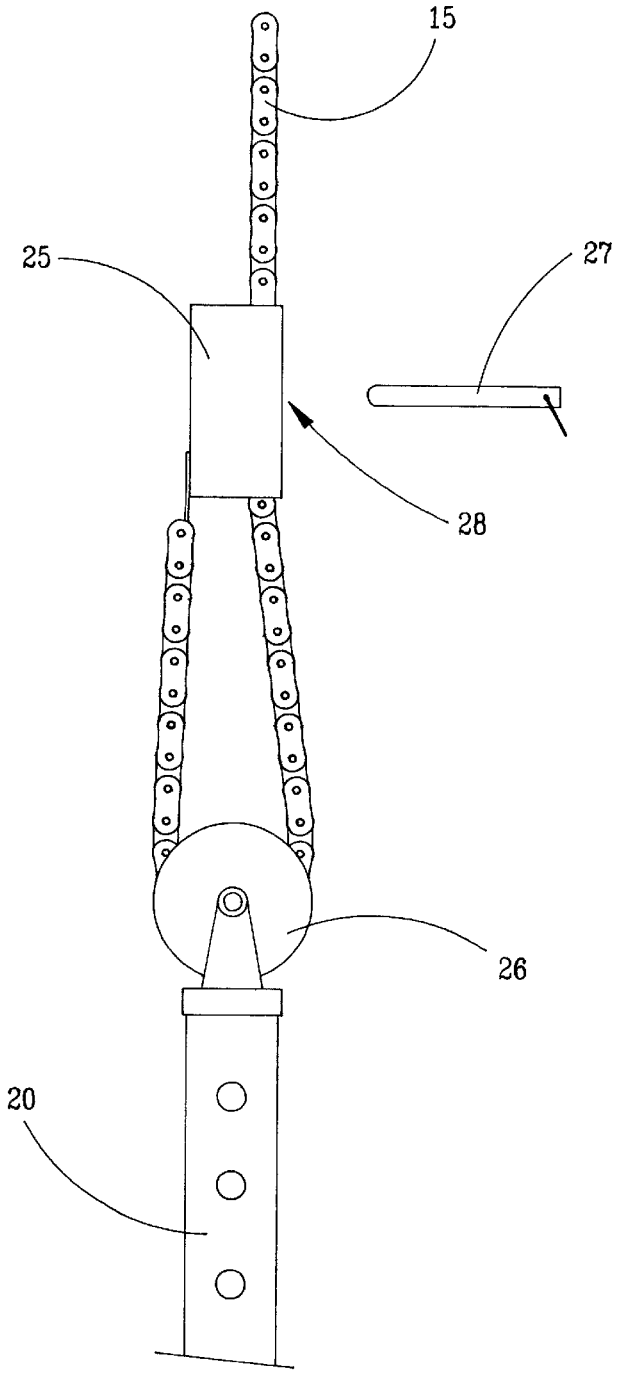
FIG. 4 provides a view from the side of the linkage adjustment bracket for the chain with its related elements.

The procedure for changing the direction of resistance (moving the chain 15 from its first position as illustrated in FIG. 2 to its second position as illustrated in FIG. 4, or vice versa) is extremely simple. First, the lever arm 12 is removed from first axle 10, so that it provides no resistance to rotation of the first axle 10 and the gearbox sprocket 16. Second, the pull pin 27 is removed from the bracket hole 28 so that the linkage adjustment bracket 25 may be slid downward on the chain 15 to create some slack in the chain 15. Third, the sprocket handle 29 is used (by turning it past the 6:00 position) to rotate the gearbox sprocket 16 a full 180 degrees so that the chain 15 is now in the position opposite its starting position. Fourth, the lever arm 12 is placed back on the first axle 10 and slack is taken out of chain 15 utilizing the linkage adjustment bracket 25 in the manner discussed above.

The embodiment illustrated may be supplemented by the addition of a weight bench, a weight bench with leg exercise interface, and a butterfly exercise apparatus utilizing techniques well known in this art area. Further, it may be constructed in numerous other configurations. Thus, it would, by way of example, also be possible to construct a variation of this invention in which the linear member on which sleeve 6 was mounted was horizontal rather than vertical. Such variations, and numerous others, are possible without exceeding the ambit and scope of the inventive concept as set forth in the claims below.

I claim:

1. A Multiexercise Weight Lifting Machine, comprising:

(a) a linear member;

(b) a direct drive gear box having a first axle and a second axle, which direct drive gear box multiplies a torque applied to said first axle thereof such that a greater amount of torque is produced at said second axle thereof, which direct drive gear box is slidably mounted on said linear member and is nonpermanently affixed to said linear member at a plurality of locations along said linear member;

(c) a variable resistance means having a variable resistance element and a flexible connective linkage chain, which variable resistance element is connected to the first axle of said direct drive gear box via said flexible connective linkage chain, which flexible connective linkage chain winds coaxially around said first axle when said first axle is rotated, and which variable resistance element supplies means for applying torque to the first axle of said direct drive gear box;

(d) a user interface element connected to the second axle of said direct drive gear box, which user interface element allows the user to apply torque to said second axle in opposition to the torque applied by the resistance element; and (e) chain overlap enabling means whereby said flexible connective linkage chain is enabled to wind coaxially around said first axle through more than one complete rotation of said first axle.

2. A Multiexercise Weight Lifting Machine as described in claim 1, further comprising means to adjust the length of said flexible connective linkage chain so that said direct drive gearbox can be repositioned at any of said plurality of locations along said linear member and said flexible connective linkage chain can be adjusted to the correct length necessary to maintain a taut connection between said direct drive gearbox and said variable resistance element.

3. A Multiexercise Weight Lifting Machine as described in claim 2, wherein said user interface element is comprised of a substantially linear lever arm having a first end and a second end, which first end of said substantially linear lever arm is connected to said second axle such that said substantially linear lever arm is at right angles to the axis of rotation for said second axle as defined by said second axle, and which second end of said substantially linear lever arm is distant from said second axle and is provided with means by which it may be physically contacted and moved by a user.

4. A Multiexercise Weight Lifting Machine as described in claim 3, further comprising means for reversing the direction of the torque applied to the first axle of the direct drive gear box by the variable resistance element.

5. A Multiexercise Weight Lifting Machine as described in claim 4, wherein the amount by which the direct drive gear box multiplies the torque applied to the first axle thereof is variable by the user.

6. A multiexercise Weight Lifting Machine as described in claim 5, wherein said chain overlap enabling means is a spiral sprocket assembly coaxially affixed to said first axle.

7. A Multiexercise Weight Lifting Machine as described in claim 3, wherein the amount by which the direct drive gear box multiplies the torque applied to the first axle thereof is variable by the user.

8. A Multiexercise Weight Lifting Machine as described in claim 2, further comprising means for reversing the direction of the torque applied to the first axle of the direct drive gear box by the variable resistance element.

9. A Multiexercise Weight Lifting Machine as described in claim 8, wherein the amount by which the direct drive gear box multiplies the torque applied to the first axle thereof is variable by the user.

10. A Multiexercise Weight Lifting Machine as described in claim 2, wherein the amount by which the direct drive gear box multiplies the torque applied to the first axle thereof is variable by the user.

11. A multiexercise Weight Lifting Machine as described in claim 2, wherein said chain overlap enabling means is a spiral sprocket assembly coaxially affixed to said first axle.

12. A Multiexercise Weight Lifting Machine as described in claim 1, wherein said user interface element is comprised of a substantially linear lever arm having a first end and a second end, which first end of said substantially linear lever arm is connected to said second axle such that said substantially linear lever arm is at right angles to the axis of rotation for said second axle as defined by said second axle, and which second end of said substantially linear lever arm is distant from said second axle and is provided with means by which it may be physically contacted and moved by a user.

13. A Multiexercise Weight Lifting Machine as described in claim 12, further comprising means for reversing the direction of the torque applied to the first axle of the direct drive gear box by the variable resistance element.

14. A Multiexercise Weight Lifting Machine as described in claim 13, wherein the amount by which the direct drive gear box multiplies the torque applied to the first axle thereof is variable by the user.

15. A multiexercise Weight Lifting Machine as described in claim 14, wherein said chain overlap enabling means is a spiral sprocket assembly coaxially affixed to said first axle.

16. A Multiexercise Weight Lifting Machine as described in claim 12, wherein the amount by which the direct drive gear box multiplies the torque applied to the first axle thereof is variable by the user.

17. A Multiexercise Weight Lifting Machine as described in claim 1, further comprising means for reversing the direction of the torque applied to the first axle of the direct drive gear box by the variable resistance element.

18. A Multiexercise Weight Lifting Machine as described in claim 17, wherein the amount by which the direct drive gear box multiplies the torque applied to the first axle thereof is variable by the user.

19. A Multiexercise Weight Lifting Machine as described in claim 1, wherein the amount by which the direct drive gear box multiplies the torque applied to the first axle thereof is variable by the user.

20. A multiexercise Weight Lifting Machine as described in claim 1, wherein said chain overlap enabling means is a spiral sprocket assembly coaxially affixed to said first axle.

* * * * *